United States Patent [19]

Dickinson et al.

[11] Patent Number: 4,763,734

[45] Date of Patent: Aug. 16, 1988

[54] EARTH DRILLING METHOD AND APPARATUS USING MULTIPLE HYDRAULIC FORCES

[75] Inventors: Ben W. O. Dickinson, 2125 Broderick St., San Francisco, Calif. 94115; Robert W. Dickinson, Marin County; David T. Rabb, Alameda County, both of Calif.

[73] Assignee: Ben W. O. Dickinson, San Francisco, Calif.

[21] Appl. No.: 811,577

[22] Filed: Dec. 23, 1985

[51] Int. Cl.[4] ..... E21B 7/08

[52] U.S. Cl. ..... 175/61; 166/117.5; 175/62; 175/67; 175/75

[58] Field of Search ..... 166/117.5, 117.6; 175/61, 62, 65, 67, 70, 73, 75, 80, 321, 422

[56] References Cited

U.S. PATENT DOCUMENTS

| | | | |
|---|---|---|---|
| 789,324 | 5/1905 | Jubb | 175/67 |
| 2,538,545 | 1/1951 | Whitehead et al. | 175/80 |
| 3,191,697 | 6/1965 | Haines | 175/422 R |
| 3,873,156 | 3/1975 | Jacoby | 175/61 |

*Primary Examiner*—Stephen J. Novosad
*Assistant Examiner*—William P. Neuder
*Attorney, Agent, or Firm*—Flehr, Hohbach, Test, Albritton & Herbert

[57] ABSTRACT

A system for the formation of a bore hole, particularly for use in enhancing the recovery of oil from an oil bearing underground formation using an assembly including a driving fluid chamber, sealed from a driving fluid chamber, and a drill string terminating in a hydraulic drillhead which passes drilling fluid into the formation. Pressurized fluid from the drilling fluid chamber is applied against the drillhead to pull the drill string into the formation, while pressurized fluid from the drilling fluid chamber pushes the drill string forward from the rear. In a preferred embodiment, the forward end of the guide tube includes a whipstock through which the piston body turns from a vertical to a horizontal direction into the formation to provide a radial for the injection of steam.

15 Claims, 5 Drawing Sheets

EARTH DRILLING METHOD AND APPARATUS USING MULTIPLE HYDRAULIC FORCES

CROSS-REFERENCE TO RELATED APPLICATION

Reference is made to Dickinson et al. application entitled Mechanically Actuated Whipstock Assembly, filed simultaneously herewith.

BACKGROUND OF THE INVENTION

This invention relates generally to earth well drilling apparatus and methods. Particularly it relates to apparatus and methods applicable to drilling one or more bore holes in a mineral bearing formation using multiple hydraulic forces.

A conventional drill hole for producing oil from an oil-bearing formation is formed by drilling with a bit driven by a rotating drill pipe which extends through the central opening of a well. A drilling fluid is passed centrally through the drill pipe to remove the cuttings in the excavated area ahead of the bit to form a slurry which is pumped to the surface in an annular space formed between the drill pipe and adjacent earth formation. After drilling, a casing is placed into the bore hole and cemented to the formation.

There are a number of disadvantages in the use of the foregoing technique. Firstly, it is expensive to drill into the earth with a rotating drill system at extended depths. Secondly, it is difficult to change the direction of the drilling from vertical to horizontal, as would be desirable for efficient production of petroleum in some situations. Thirdly, the rotation of the drill pipe to which the bit is attached within the casing creates great friction, power loss, and wear of both drill pipe and casing.

By the use of known whipstock devices and techniques, a bore hole may be directed laterally from the vertical. However, transition from a vertical to a horizontal bore hole presents difficulties, particularly when a small turning radius is desired (e.g. less than a ten foot radius), to permit injection of steam, solvents or other fluids into the formation for enhanced recovery of minerals. This capability is particularly desirable for heavy (high viscosity) oil-bearing formations.

A number of techniques have been attempted to form lateral or radial (essentially horizontal) bore holes from a vertical, cased bore hole. In one technique, an oversized vertical bore hole is formed of sufficiently large diameter such that miners may descend to a location bear the bottom of the hole, from which they can drill horizontal holes by conventional means. This technique is both costly and dangerous, particularly at great depths. In another approach, a technique known as drain-hole drilling is employed. Here, a vertical bore hole is bored with rotary equipment in a conventional way. A special assembly is attached near the lower end of the drill column, including a pre-formed, non-rotating, curved guide tube known as a whipstock, and an inner, flexibly jointed, rotatable drive pipe. Then, the drill passes along the curved assembly in a generally lateral direction to drill a lateral. A variety of such systems are set forth in the following U.S. Pat. Nos. 2,669,429, Zublin Feb. 16, 1954; 2,797,893, McCune et al. July 2, 1957; and 3,398,804, Holbert Aug. 27, 1968. Multiple whipstocks for directing drill pipes at oblique angles are suggested in Owsley et al., U.S. Pat. No. 3,330,349, July 11, 1962. All of these systems are subject to the disadvantage that there is a high frictional relationship between the curved, flexibly jointed drill pipe and the adjacent formation, and it is difficult to form truly horizontal bore holes; instead, downwardly directed bore holes with relatively large turning radii are formed. In some instances horizontal bore holes have been drilled, but with the use of whipstock means which applies a relatively large radius turn or bend. In additon, such bore holes are costly to drill and directional control is erratic. Another disadvantage is that the deflected rotating drill pipe tends to wear out quickly due to continuous frictional contact with the formation. In addition, the friction between the deflected rotating drill pipe and the formation limits the extent to which the drill can penetrate the formation before being stopped.

A variant of the drain-hole principle for subterranean boring is disclosed in Grebe U.S. Pat. No. 2,271,005, Jan. 23, 1939. There, a flexible drilling conduit terminating in an elongate bullet-shaped hydraulic drillhead with multiple ports passes through a curved guide tube. A hydraulic fluid, such as acid solution, is pumped through the conduit from the surface of the well and discharged from the drilling head to form a radially directed bore as the drilling head is advanced. A complex system is disclosed for driving the conduit incrementally forward by the application of force thereto and by periodic inflation and deflation of inflatable packers spaced in the conduit. The resulting discontinuous creeping movement of the conduit is analogous to that of an earth worm.

A system somewhat similar to the aforementioned Grebe patent is disclosed in Chamberlain, U.S. Pat. No. 2,258,001, Oct. 7, 1944. There too, a flexible drilling conduit is utilized which terminates in a bullet-shaped nozzle with multiple ports. An acid is discharged from the drillhead to cut through the formation. Advancing movement of the drillhead into the formation is controlled by means at the top of the well which counterbalances the weight of the conduit. There is no indication how the systems of Grebe or Chamberlain could maintain a precise horizontal direction in view of the flexibility of the pipe.

Other patents disclose radials without precise information as to the mode of producing the radials in the formation. For example, Anderson et al., U.S. Pat. No. 3,994,340, Nov. 30, 1976, discloses a radial for the injection of steam into viscous petroleum formation with a production well adajacent one end of the formation.

In Pisio et al., U.S. Pat. No. 4,020,901, May 3, 1977, a complex arrangement is disclosed which suggests that steam injection and production could be accomplished in a single well. There are no details disclosed regarding the well casing. However, it is of such a large size that it appears the technique is such that miners descend to a location near the bottom of the well to drill horizontal holes.

Granville, U.S. Pat. No. 1,367,042 discloses a flexible metal tube which is stated to turn at a right angle and with a rotating drill head at its forward end. A shaft 12 is included to rotate the drill. Such a shaft would tend to flail around inside the flexible tube to destroy it. It also limits the area at the drillhead against which fluid pressure may be applied. Another problem with Granville is that it requires the use of flexible tubing which would tend to buckle this. This leads to large frictional forces between the buckling flexible tube and rigid pipe. Also, there is metal to metal contact along the entire surface of rigid pipe 3. The total frictional forces would prevent the flexible pipe from moving forward to any significant extent.

In Dickinson et al. U.S. Pat. No. 4,527,639, a piston-like system is disclosed which permits the turning of rigid pipe through a short radius 90° turn. This is accomplished by directing hydraulic fluid against the rearward side of a drillhead at the forward end of the drilling pipe to provide a "pulling" force at the drillhead to move the pipe into the formation without buckling of the pipe. The pipe moves through a seal in a surrounding guidepipe to permit the application of such forces which are sufficient to carry the drillhead and pipe through the short radius turn set forth above. The ability to use a rigid pipe is a major advance in that it avoids the buckling likely in a flexible pipe which, if it reached reached the formation, would tend to wander undirected to prevent the precise placement of radials.

The above system of U.S. Pat. No. 4,527,639, is a major advance over earlier prior art. It would be improved even further by the ability to provide additive forces in addition to the pulling forces which would assist in moving the rigid pipe through the whipstock long distances into the underground formation. Such additional forces could also be used to control the rate of movement of the radial pipe and to the formation.

SUMMARY OF THE INVENTION

The present invention is directed primarily to a system for the formation of a bore hole for use in a recovery or enhancement in the recovery of oil from an oil-bearing formation, or for the recovery of mineral deposits or the like, or for drilling through an underground formation for some other purpose. The system includes means defining a driving fluid chamber and means for defining a drilling fluid chamber. A drill string with an interior fluid passageway extend from the former chamber to the latter one. A drillhead of the hydraulic jet type is attached to the forward end of the drill string in communication with the interior passageway. A first seal is disposed between the driving fluid chamber means and the drill string while a second seal is disposed between the drilling fluid chamber means and the drill string. The drill string interior passageway is substantially sealed from the driving fluid chamber and is in communication with the drilling fluid chamber. When pressurized fluid is supplied to the driving fluid chamber, it drives the drill string forward. When pressurized fluid is supplied to the drilling fluid chamber, it flows from the drilling fluid chamber through the interior passageway to apply pressure against the drillhead. The pressurized fluid causes the drill string to move forward into the formation and causes the pressurized fluid to be directed against the formation.

In a preferred embodiment, bending means, specifically a whipstock, is disposed downstream from the first seal which causes the drill string to turn from the vertical to the generally horizontal direction in a short radius turn.

DETAILED DESCRIPTION OF THE PREFERRED EMBODIMENTS

In one major use of the present invention, a system is provided for forming one or more radial pipes or tubes in radial bores extending from a pre-existing cased well. A major use of such radial pipe is to inject a hot fluid such as steam or solvents into the surrounding formation to render high viscosity oil in the underground formation more flowable. An important application is to heat oil left in the ground by a production well system which has ceased producing economically.

In general, the present invention comprises an improvement over the hydraulic piston-effect method and apparatus of co-pending application Ser. No. 471,434. That application describes a system in which hydraulic forces are applied against a drillhead to pull a pipe into the formation. The present system adds to that pulling force a pushing force from the other end of the drill pipe.

Figure 1:
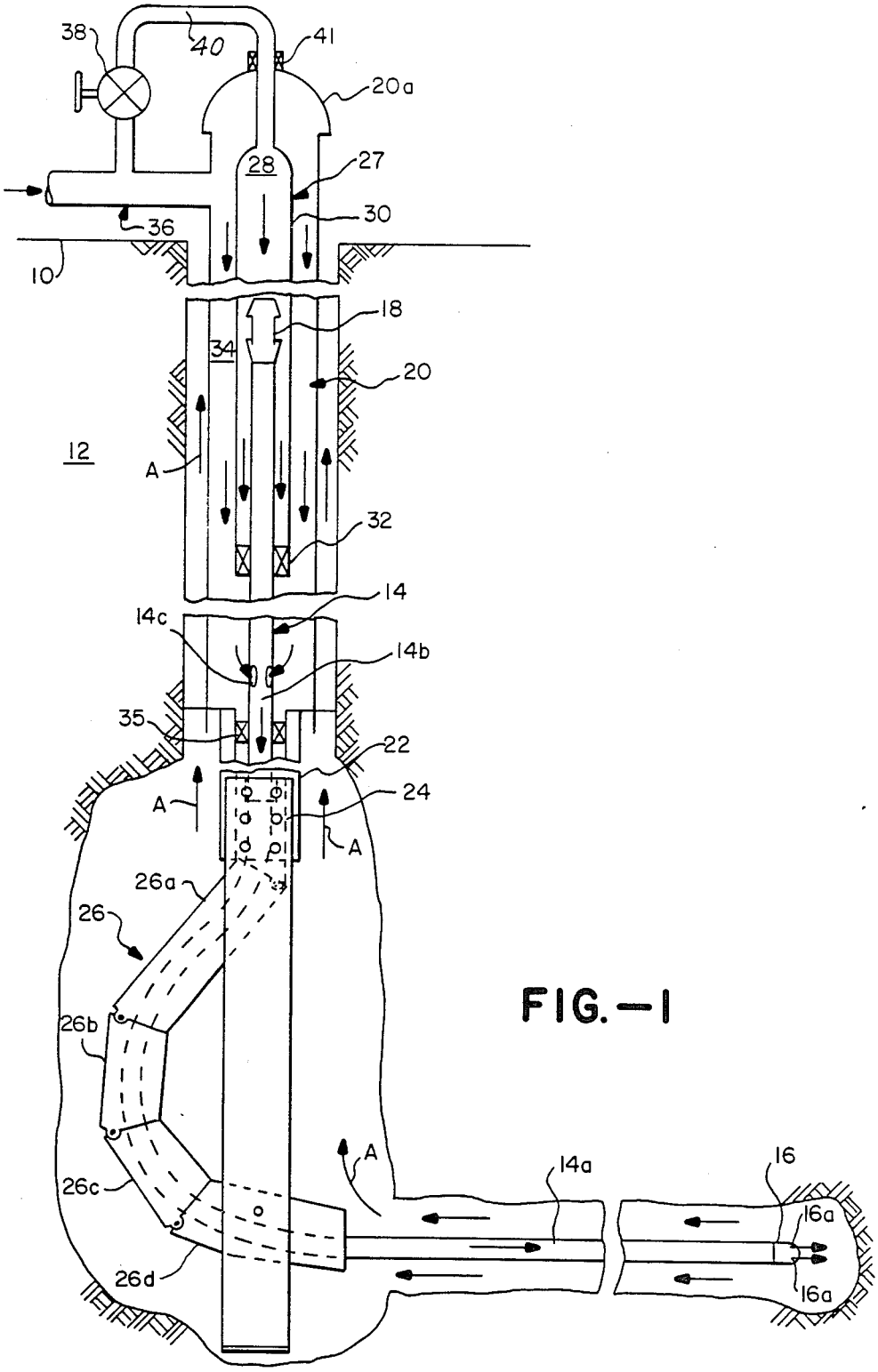
FIG. 1 is a side elevational view in section illustrating a drill string assembly in accordance with the invention used for moving a radial into the formation.

Referring to the embodiment of FIG. 1, the ground level 10 above the underground mineral bearing formation 12 is illustrated. A drill string 14 is formed of a metal tube of the solid wall type which may, for example, have an outer diameter (OD) of approximately 1.25 in. and of a character which may be coiled on a spool and passed downwardly into the system prior to sealing the system into the form shown in FIG. 1. When sufficient length of the drill string is provided to reach the desired ultimate radial length, the string is severed and lowered down the guide pipe.

As used herein, the term "drill string" encompasses a single unitary hollow pipe of the type which may be used for radial hollow tube section **14*a* or multiple sections connected together, some of which may not be hollow, such as a sucker rod with threaded attachments to each end to provide dead weight as described in embodiments set forth hereinafter. Drill string 14 is typically in the form of a hollow pipe and defines an interior passageway 14*b* which extends from drillhead 16 upstream in the system to multiple ports 14*c* for reasons described below. Upstream of ports 14*c*** may comprise a hollow or solid pipe so long as the interior passageway is sealed towards the top of the drill string.

In the illustrated embodiment, drill string 14 comprises a pipe connected at its forward end to drillhead means 16 of the hydraulic jet type including multiple ports **16*a* through which the drilling fluid exits to bear against and erode the formation in its path. A removable cap 18 is secured into the other end of drill string 14. The purpose for the cap is to seal the interior of drill string 14 at the location of the cap. The cap may be removed periodically to permit the lowering of a wire line tool through the system to determine the position of the drillhead 16** at any point in time.

As illustrated, the system operates within a pre-existing cemented-in well casing 19 in which outer piping 20 is mounted leaving an annular chamber 21 therebetween suitable for the passage of cuttings from the drillhead as described below. Outer piping 20 is sealed at its lower end to a guide pipe 22 including interior rollers 24. Guide pipe 22 is in turn connected to whipstock means 26 which includes four segments 26*a*, 26*b*, 26*c*, 26*d* and 26*e* in an inverted comma position. Drill string 14 moves through rollers 24 and whipstock means 26 to turn from a generally vertical direction to a generally horizontal direction forming radial 14*a*. Whipstock means 26 is lowered into the formation in a collapsed position and is formed in situ into a whipstock of the illustrated shape in the manner described in Dickinson et al. patent application entitled Mechanically Actuated Whipstock Assembly filed simultaneously herewith and incorporated herein by reference.

Means 27 defining a driving fluid chamber 28 is provided in the form of cylindrical inner piping 30 which is sealed from the annular space surrounding the same. A first sliding seal 32 is mounted to the inner wall of inner piping 30 through which drill string 14 slides. Inner piping 30 is surrounded by outer piping 20. Outer piping 20 and inner piping 30 at least partially define drilling fluid chamber 34 which is sealed from driving fluid chamber 28.

Means is provided for forming a seal between drilling fluid chamber 34 and drill string 14 in the form of a second seal 35 mounted to guide pipe 22 through which drill string 14 passes.

Means (not shown) is provided for supplying hydraulic fluid to driving fluid chamber 28 and drilling fluid chamber 34. As illustrated, the fluid moves through conduit 36 in which the major portion of the fluid is passed. A portion of the drilling fluid in conduit 36 may be bled off by valve means 38 into conduit 40 for passage into stationary driving fluid chamber 28. Conduit 40 passes through a sealed aperture 41, in a domed sealed top 20*a* mounted to outer piping 20. In an alternative embodiment illustrated in FIG. 2, a separate source of driving fluid may be employed.

When the system is in operation, the drill string 14 passes through whipstock means 26 and becomes a radial or lateral tube or duct 14*a* suitable for the injection of hot fluids such as steam into the formation to heat up the viscous oil for removal. In the alternative, heat from the hot fluid causes the oil to flow back towards the casing containing a production pump as well as a radial.

The general principal of forming a radial in accordance with the present invention uses (a) a hydraulic pulling force applied by urging fluid against the drillhead means 16 which thereby pulls the radial into the formation from the downstream end of the drill string in combination with (a) a hydraulic driving or pushing force applied in driving fluid chamber 28 against the upstream end of the drill string. The former type of force is generally described in the aforementioned copending patent application Ser. No. 471,434. Briefly, drill string 14 is adapted to move through seals 32 and 35, through whipstock means 26, and into the formation. An open passageway is provided from conduit 36 through drilling fluid chamber 34, ports 14*c*, into the interior fluid passageway 14*b* and forward to the rearward side of drillhead means 16.

The fluid exits through multiple fluid exit ports provided in the drillhead means for the passage of the drilling fluid into the adjacent formation. High pressure fluid flowing from drilling fluid chamber 34 applies pressure against the rearward side of the drillhead to cause drill string 14 to move in a forward direction. The only portion of the drill string which passes through whipstock 26 comprises a hollow tube in the form of a radial which is stressed and deformed plastically in a physical metallurgical sense to bend and turn into the radial, preferably in a horizontal direction, so as to be moved into the formation. The high pressure liquid issuing from the drillhead drills out the formation and forms cuttings which are slurrified and passed backwardly along the outer periphery of drill string 14 as illustrated by arrows A or FIG. 1 for movement outside the outer piping 20 to the surface. Alternatively, if the drilling fluid pressure is greater than the formation pressure, the fluid may be directed into the surrounding formation under such force that the formation fracs or fractures, causing fissures into which the formed slurry can flow, whereby little, if any, cuttings are moved rearwardly along the radial and so lifting of such cuttings is not required.

The system also includes a pushing force by fluid being passed through conduit 40 into driving fluid chamber 28 and applies against cap 18 at the top of the drill string.

The location of driving fluid chamber 28 and drilling fluid chamber 34 may be at the top of the drill string or at some point below that so long as seal 32 is above whipstock means 26. There is some advantages in placing the cylinders towards to top of the well (at the well head) in that the force may be carried to the radial by a heavy or dead weight sucker rod as described below which helps to overcome frictional forces in the whipstock. Also, a long length of tubular pipe may be eliminated and replaced with a rod since the portion of drill string 14 above ports 14*c* need not be an open passageway.

One advantage of this system is that it is capable of drilling radial bores with a non-rotating drill string, and that the bore hole may be cased while drilling.

The system may be installed as follows: A preexisting well casing placed in the surrounding formation in the vicinity of the whipstock may be underreamed by a conventional means. The whipstock may be lowered into the predetermined position by use of a string system formed of segments with threaded attachments on adjacent segments. It may remain in place and form the portion of the drill string terminating at cap 18, above ports 14*c*. Such ports maintain open communication between the interior passageway and the fluid in drilling fluid chamber 34 during movement of the radial through the whipstock and to the desired final position in the formation. This string, or a tubing string separately placed, may remain in place forming a dead weight to provide additional pushing force against the drill string. Alternatively, the string may be removed so long as there is sufficient drill string extending upwardly so that a portion extends through seal 32 from the time of driving the drill string forward through the whipstock through the ultimate placement of the radial.

After placement of drill string 14 at a position just prior to movement into the whipstock to which the hydraulic forces of the system are applied, the system can be sealed as by putting top 20*a* on the casing to seal the top of driving fluid cylinder means 28.

When the drill string is forced through whipstock means 26, bending forces are applied to cause it to conform generally to the curve of the whipstock, whereby the drill string is caused to turn towards a generally horizontal position into the formation. The details of forming this curvature are described in U.S. Pat. No. 4,527,679.

A number of systems can be employed for determining the position of the radial in the formation. For example, a reel with a line attached to the top of the drill string may be employed so long as there is access to the reel a the surface. Alternatively, an acoustical assembly may be used with a transmitted signal emitting from the drillhead which reflects back to give a measured transit time and movement. Another system would be to measure distance as a function of the displacement of fluid flowing into the driving fluid chamber. However, if the tubing joints are not completely tight, leakage may occur which could cause an error.

Figure 2:
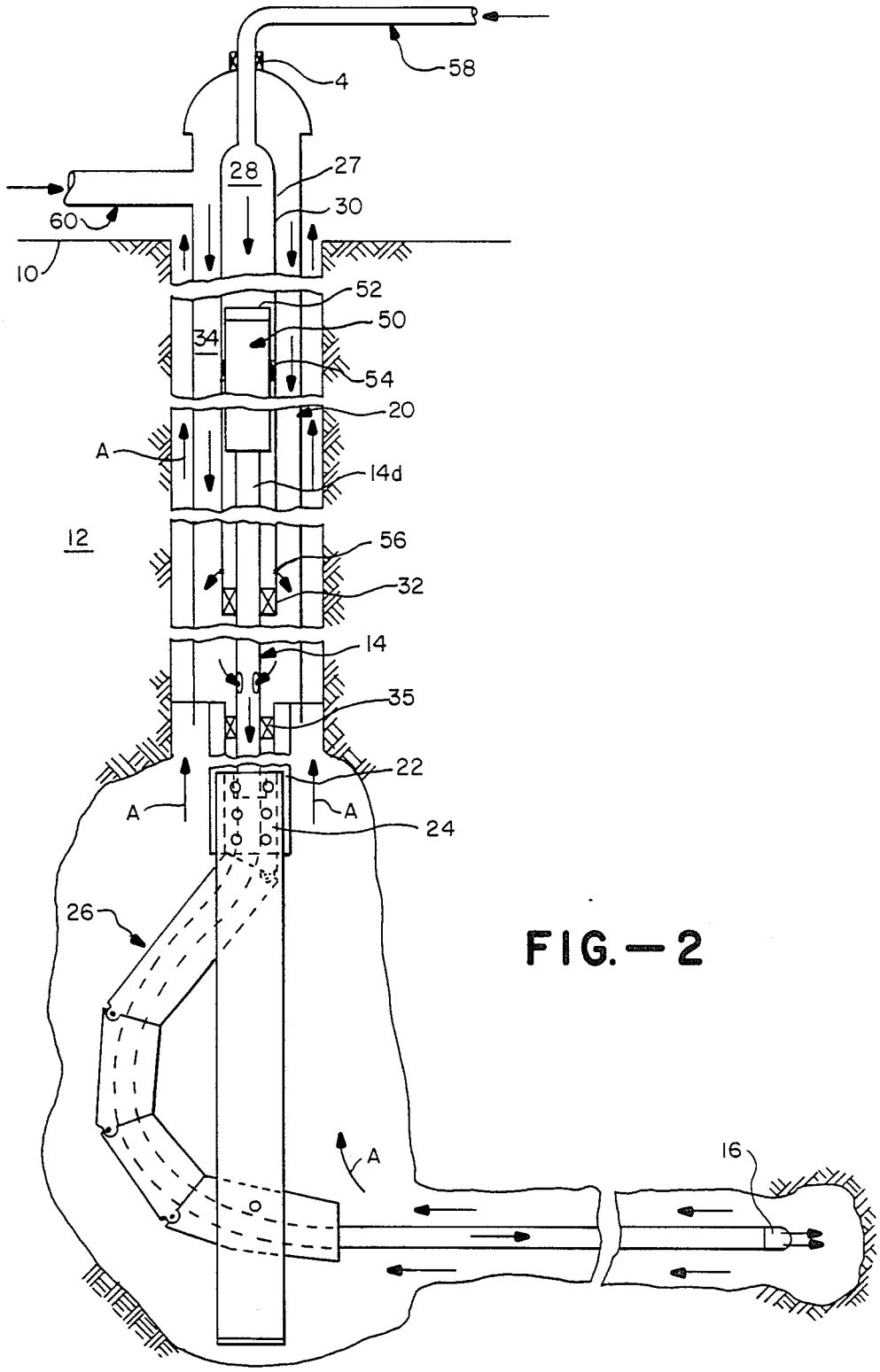
FIG. 2 is another embodiment of the device of FIG. 1 with a modified piston arrangement.

Referring to FIG. 2, another embodiment of the invention is illustrated with a different form of driving mechanism but with the remainder of the apparatus the same. Like parts will be designated with like numbers in the two systems and the description with respect to such like parts in FIG. 1 will apply to the system of FIG. 2.

In the system of FIG. 2, a piston body 50 is attached to the upstream side of drill string 14 of a cylindrical shape and having a cross-sectional area which may be substantially larger (e.g., 1.1 to 10 times, preferably 2 to 4 times larger) than the cross-sectional area of the drill string, in the plane perpendicular to the direction of movement of the piston body. It includes a removable plug 52 mounted at its top which can be removed to install a wireline device in the drill string in an analogous manner to that of plug 18. A third high pressure seal 54 is mounted to the exterior wall of piston body 50 in close sealing engagement with the cylindrical side wall of inner piping 30. (Alternatively, seal 54 may be mounted to the interior wall of inner piping 30.) Means is provided for bleeding off fluid in the chamber formed below piston body 50 and above first seal 32. Such means is in the form of ports 56 which direct the fluid to the outside of outer piping 20 without contacting or restricting the flow of fluid in chamber 34 when piston body 50 is actuated by driving fluid supplied by conduit 58 to driving fluid chamber 28. Drilling fluid is supplied by conduit 60 to drilling fluid chamber 34. Thus, in this embodiment, independent sources of fluid are provided for the two chambers.

Piston body 50 is sufficiently long so that it maintains a seal with seal 54 when a corresponding length of drill string is moved by the hydraulic forces through whipstock 26 and out the radial to the desired distance. The use of an enlarged cross-sectional area for the piston body permits a multiplication of the driving force supplied by the system. Thus, a doubling of the cross-sectional area leads to a corresponding doubling of the force which is applied to the top of the drill string when the remainder of the parameters are maintained constant. The amount of force applied against the top of piston body 50 is also controlled by the pressure of the fluid supplied by conduit 58 to driving fluid chamber 34. In this manner, a close control of the system may be maintained by varying the pressure of such driving fluid in line 58. If desired, the control may be further augmented by the use of a restraint such as a cable (not shown) which is operatively associated with the drill string such as by connection to the drill string near the top of it which controls the maximum rate of movement of the system. However, the rate of movement can be controlled by a corresponding variance in the fluid applied in line 58 without the requirement of the cable restraint.

In another embodiment, not shown, the force multiplication of the embodiment of FIG. 2 is accomplished by a system similar to the embodiment of FIG. 1. In this instance, seal 32 has a cross-sectional area substantially larger (e.g., 1.1 to 10 times, preferably 2–104 times larger) than the cross-sectional area of seal 35. The cross-section of that portion of drill string 14 which passes through seal 32 during drilling is correspondingly enlarged without enlarging the cross-seciton which passes through seal 35.

Figure 3:
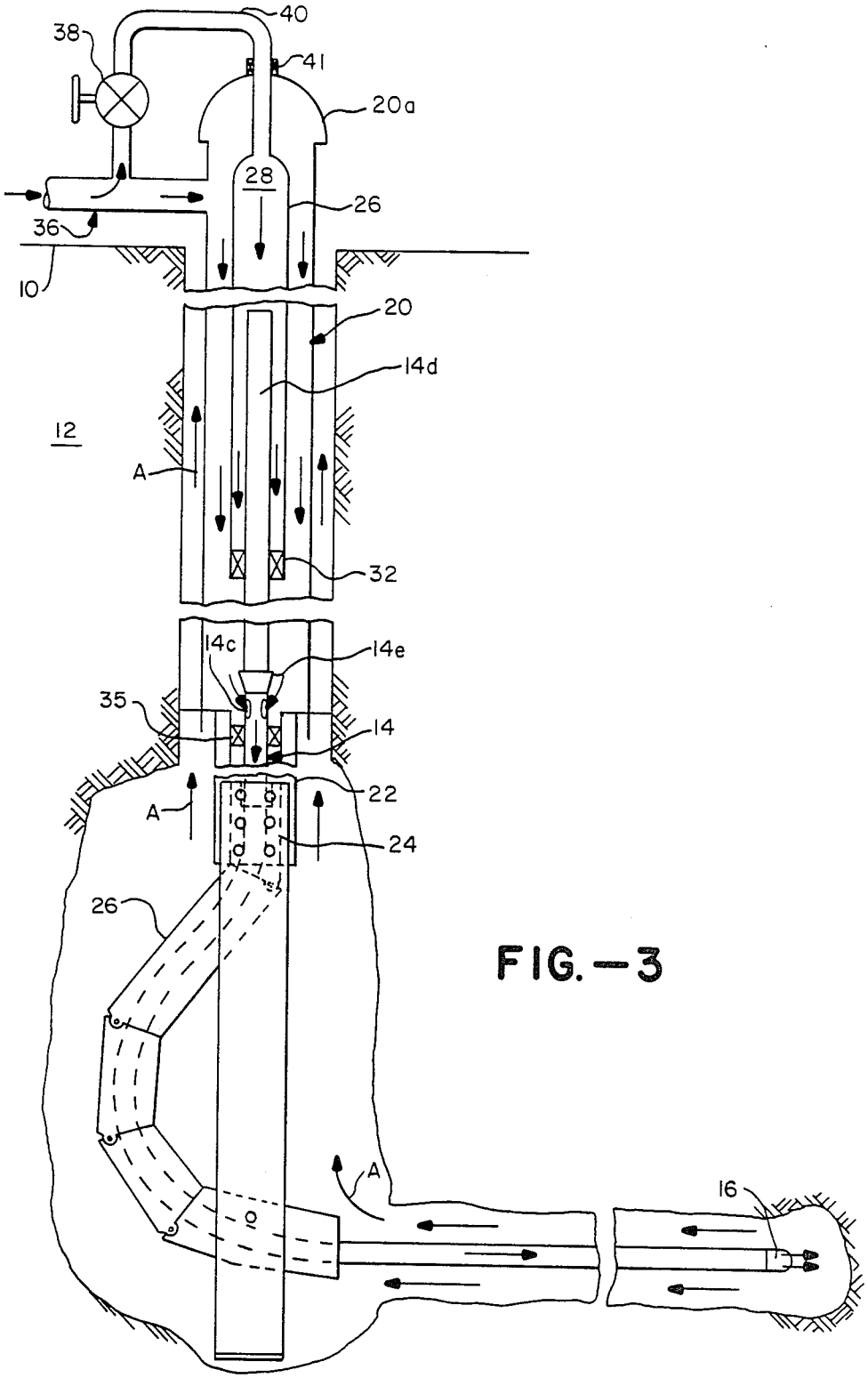
FIG. 3 is a further schematic view in section of another embodiment using a heavy rod or pipe to assist driving into the formation.

Referring to FIG. 3, another embodiment of the system of FIG. 1 is illustrated with like parts designated in like numbers. The only difference between the two systems comrpises the use of a solid metal rod portion **14*d* at the top of drill string 14. Rod 14*d* provides a dead weight driving force to the drillhead which is additive to the hydraulic forces described above. Rod 14*d* is suitably in the form of a threaded rod which may be threaded at connection 14*e* to the remainder of drill string 14. The dimensional constraints of rod 14*d* are that it be long enough to maintain a seal with seal 32 during the application of hydraulic forces and that they extend to the position no further along the drill string than a point upstream of ports 14*c*. As set forth above, below ports 14*c* an interior passageway is formed which communicates with the drillhead 16**.

Figure 4:
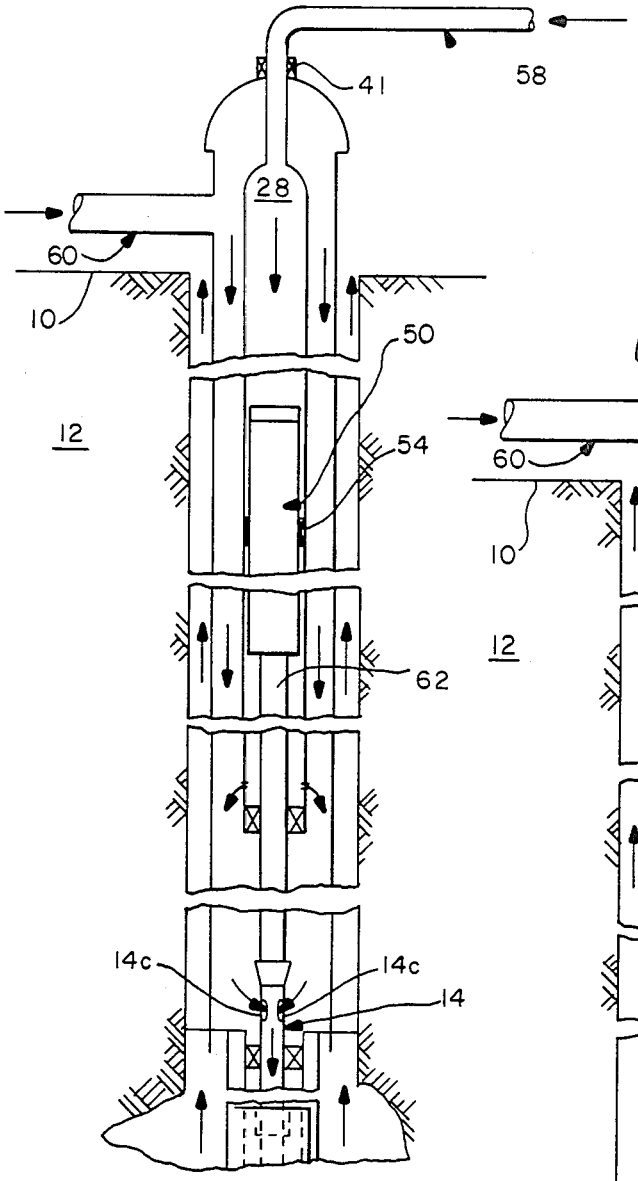
FIG. 4 is another embodiment of the invention using the piston means of FIG. 2 and rod of FIG. 3.

Referring to FIG. 4, another embodiment of the invention is illustrated which is similar to that of FIG. 2. Like parts in FIG. 4 will be designated with like numbers of FIG. 2. The difference between FIG. 2 and FIG. 4 is in the area of the drill string above ports **14*c*. In the instance of FIG. 4, a solid metal rod portion 62 interconnects the bottom of piston body 50 and the area of drill string above ports 14*c*. Such rod 62 constitutes, in essence, a piston rod in the form of a sucker rod with screw threaded connections to both the piston body and top of the drill string. One advantage of this interconnection is that it provides the additional dead weight to drive the drill head described with respect to FIG. 3**.

Figure 5:
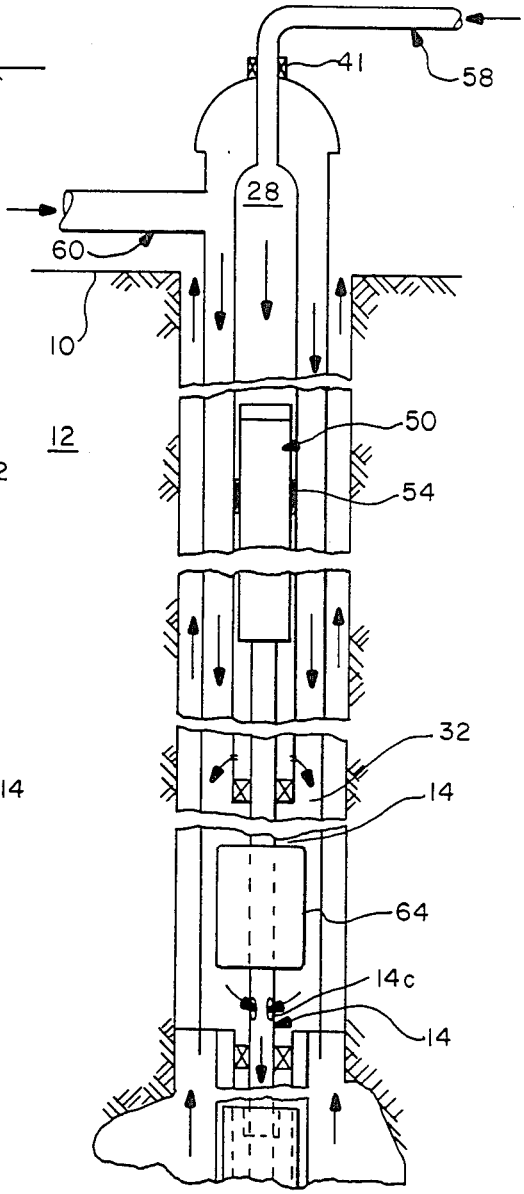
FIG. 5 is an embodiment of a portion of the device of FIG. 1 using a drill collar to provide additonal driving force.

Referring to FIG. 5 an embodiment of the invention is illustrated similar to that of FIG. 2. In this instance, a continuous hollow pipe drill string 14 is illustrated as in FIG. 2. The major difference in the two embodiments is the inclusion of a weighted drill collar 64 mounted to the drill string at a point below seal 32 and above ports **14*c***. The advantage of this location is that the drill collar need not pass through any seals. The dead weight may be also added at some other point in the system so long as it does not interfere with any of the seals.

Drillhead 16 may be of any type which provides a rearward surface against which the force of the drilling fluid has directed and which provides ports through which the drilling fluid may exit, preferably in a direction axially aligned with the horizontal drilling path of the radial hole, together with other ports in other directions, if desired. Suitable drillheads for use in accordance with the present invention are described in U.S. Pat. No. 4,527,639.

The foregoing systems constitute an improvement over the system of U.S. Pat. No. 4,527,639 in the provision of the various forces to move the drill string through the whipstock and into the formation. The dead weight forces facilitate the system to overcome frictional forces in the whipstock and the formation. The hydraulic driving forces transmitted in driving fluid chamber 28 provide further hydraulic forces together with precise control of the amount of force to be applied depending upon the formation into which the radial is to move. If the system requires particularly large forces to move the radial into the formation, the cross-sectional area of the piston of FIG. 2 may be increased to provide such assistance.

Another advantage resides in the separation of the fluid applying hydraulic forces in isolated driving fluid chamber 28 and drilling fluid chamber 34 because the required fluid pressure in the former chamber, being isolated from the large volume drilling fluid in the latter chamber, provides a precise measure of the resistance to movement of the drillhead. It has been found that when this pressure exceeds a predetermined level, the system may have become irreversibly stuck embedded in a resistant area of the formation if drilling continues. By monitoring the driving fluid pressure, when this level is exceeded, the drill string may be withdrawn a short distance and the hole redrilled, resulting in avoidance of the sticking problem.

Figure 6:
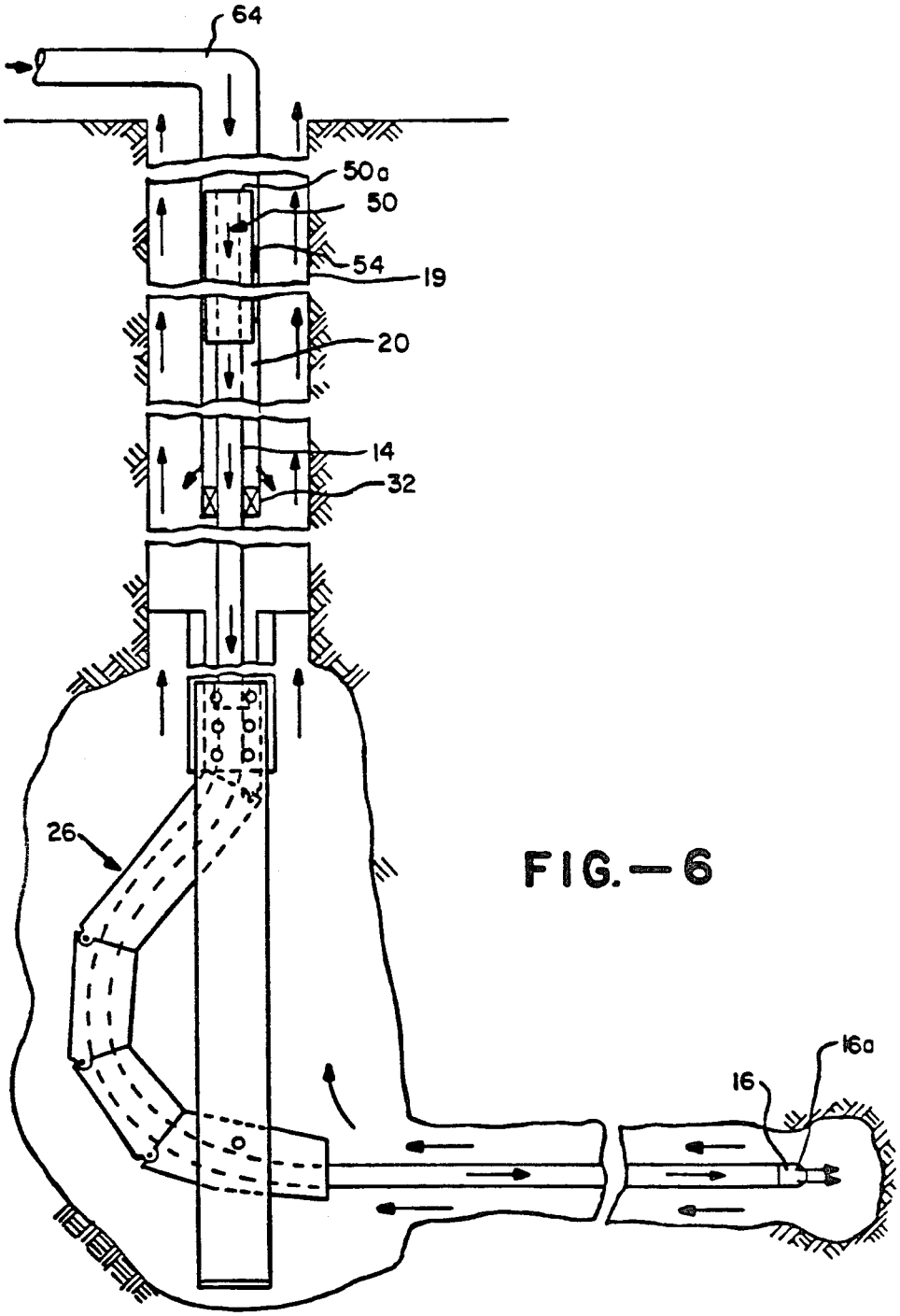
FIG. 6 is an embodiment of the invention with an open topped drill string.

Referring to FIG. 6, a further embodiment is illustrated with a single fluid source and an open-topped drill string. The embodiment is similar to that of FIG. 2, and so like numbers will be used to designate like parts. Instead of separate conduits 58 and 60 for piston driving fluid and drilling fluid respectively, a single conduit 64 provides fluid for both functions. To do so, piston body 50 includes a hollow lumen and an open top 50*a* so that the fluid passes through from the open top through the lumen of drill string 14 and out ports 16*a* of drillhead 16. As described regarding FIG. 2, the enlarged seal 54 relative to seal 32 provides a force multiplication to the system. Other differences of FIG. 6 from FIG. 2 are that parts 14*c* and seal 35 are eliminated because all fluid provided to the system passes through the open top of piston body 50. Overall the system of FIG. 6 is a simplication from that of FIG. 2 since it eliminates dual fluid sources and seal 35. Conversely, it does not include the advantage of the control achieved by separation of the piston driving fluid force from the drilling fluid source.

What is claimed is:

1. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber, port means in said drill string disposed between said first and second seal means to provide fluid communication between said drilling fluid chamber and the interior fluid passageway, whereby when pressurized fluid is supplied to the driving fluid chamber means, it drives the drill string forward through the first and second seals and when pressurized fluid is supplied to the drilling fluid chamber means it flows from the drilling fluid chamber means through said port means and the interior passageway to apply pressure against the drillhead, thereby causing the drill string to move forward into the formation and causing the pressurized fluid to be directed against the formation.

2. The apparatus of claim 1 in which the driving fluid chamber means includes piping and the first sealing means is attached to the inner surface of said piping in fluid sealing engagement with said drill string.

3. The apparatus of claim 1 together with means for supplying fluid under pressure to the drilling fluid chamber and to the driving fluid chamber.

4. The apparatus of claim 3 together with valve means operatively associated with said fluid supply means for supplying fluid to the drilling fluid chamber and to the driving fluid chamber from a single source.

5. The apparatus of claim 1 together with restraint means operatively associated with said drilling string for controlling the maximum rate of movement thereof.

6. The apparatus of claim 1 together with whipstock means disposed downstream of said first seal, said drill string substantially changing direction on movement through said whipstock means.

7. Earth well drilling apparatus comprising a structure adapted to be positioned within the well adjacent to an underground formation, inner and outer piping within the well to which the structure is secured, said outer piping at least partially defining a drilling fluid chamber, said inner piping at least partially defining a driving fluid chamber sealed from said drilling fluid chamber, a drill string having a closed top and including a tubular wall, said tubular wall defining an interior fluid passageway and having at least one sidewall fluid port, means forming a first sliding seal between the inner piping and the drill string in said driving chamber, means forming a second seal downstream from said first seal between said drill string and said drilling fluid chamber, a drillhead of the hydraulic jet type secured to the forward end of said drill string and in fluid communication with said interior fluid passageway, said sidewall fluid port being in fluid communication with said drilling fluid chamber, said drill string extending from said driving fluid chamber through said first seal into said drilling fluid chamber and then through said second seal, said sidewall port being disposed in said drilling fluid chamber, and means for supplying fluid under pressure to the drilling fluid chamber and to the driving fluid chamber, whereby pressurized fluid in the driving fluid chamber drives the drill string forward and pressurized fluid flows from the drilling fluid chamber through the interior passageway to apply pressure against the drillhead to cause the drill string to move forward into the formation and to cause pressurized fluid to be directed against the formation.

8. A method for forming a bore hole in an underground formation using a drilling system comprising a drilling fluid chamber sealed from a driving fluid chamber, and a drill string with an interior passageway in communication with a drillhead of the hydraulic jet type at its forward end and sealed from said driving fluid chamber, said method comprising the steps of:

(a) disposing said drill string with its upstream end in said driving fluid chamber with said interior passageway sealed therefrom, said drill string extending through a first sliding seal in said driving fluid chamber and then through a second sliding seal in said drilling fluid chamber with said drillhead is downstream of both seals, said interior passageway communicating with fluid in said drilling fluid chamber but not with fluid in said driving fluid chamber, (b) directing fluid into said driving fluid chamber upstream of said first seal to push said drill string downstream, and (c) simultaneously directing fluid into said drilling fluid chamber through ports in said drill string into said interior passageway to apply pressure against said drillhead to move said drillhead into the formation and to cause pressurized fluid to be applied against the formation.

9. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber and being in communication with said drilling fluid chamber, said drill string including an upstream piston body portion with an enlarged cross-section relative to the downstream portion of said drill string, third sliding seal means between the upstream piston body portion and the driving chamber means above said second seal, and means for bleeding off fluid disposed in said inner piping between said third seal and second seal, whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation.

10. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber and being in communication with said drilling fluid chamber, and whipstock means disposed downstream of said first seal, said drill string substantially changing direction on movement through said whipstock means, and a connecting guide pipe disposed between said first seal and said whipstock means, whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation.

11. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber and being in communication with said drilling fluid chamber, and said drill string including a solid metal rod portion to provide a dead weight driving force to the drillhead, whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation.

12. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber and being in communication with said drilling fluid chamber, and a weighted drill collar above said second seal to provide a dead weight driving force to the drillhead, whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation.

13. A method for forming a bore hole in an underground formation using a drilling system comprising a drilling fluid chamber sealed from a driving fluid chamber, and a drill string with an interior passageway in communication with a drillhead of the hydraulic jet type at its forward end and sealed from said driving fluid chamber, a piston body at the upper end of said drill string of an enlarged cross-section relative to the drill string cross-section area and also including third sliding seal between the piston body and the driving chamber means above said second seal said method comprising the steps of:

(a) disposing said drill string with its upstream end in said driving fluid chamber with said interior passageway sealed therefrom, said drill string extending through a first sliding seal in said driving fluid chamber and then through a second sliding seal in said drilling fluid chamber with said drillhead is downstream of both seals, said interior passageway communicating with fluid in said drilling fluid chamber, (b) directing fluid into said driving fluid chamber upstream of said first seal against the upstream side of said piston body to push said drill string downstream, (c) simultaneously directing fluid into said drilling fluid chamber through said interior passageway to apply pressure against said drillhead to move said drillhead into the formation and to cause pressurized fluid to be applied against the formation, and (d) passing said drill string through a whipstock disposed downstream of said first seal in which it changes directions.

14. Earth well drilling apparatus comprising a structure adapted to be positioned within the well adjacent an underground formation, said apparatus comprising means defining a drilling fluid chamber, means defining a driving fluid chamber including piping, a drill string with an interior fluid passsageway and extending from said driving fluid chamber through said drilling fluid chamber, drillhead means of the hydraulic jet type attached to the forward end of said drill string in communication with said interior passageway, first sliding seal means attached to the inner surface of said piping disposed between said driving fluid chamber means and said drill string in fluid sealing engagement with said drill string, second sliding seal means disposed between said drilling fluid chamber means and said drill string, said drill string interior passageway being substantially sealed from said driving fluid chamber and being in communication with said drilling fluid chamber whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation.

15. Earth well drilling apparatus comprising a structure adapted to be positioned within the well adjacent an underground formation, said apparatus comprising means defining a drilling fluid chamber, means defining a driving fluid chamber, a drill string with an interior fluid passageway and extending from said driving fluid chamber through said drilling fluid chamber, drillhead means of the hydraulic jet type attached to the forward end of said drill string in communication with said interior passageway, first sliding seal means disposed between said driving fluid chamber means and said drill string, second sliding seal means disposed between said drilling fluid chamber means and said drill string, said drill string interior passageway being substantially sealed from said driving fluid chamber and being in communication with said drilling fluid chamber, whereby when pressurized fluid is supplied to the driving fluid chamber means, it drives the drill string forward through the first and second seals and when pressurized fluid is supplied to the drilling fluid chamber means it flows from the drilling fluid chamber means through the interior passageway to apply pressure against the drillhead, thereby causing the drill string to move forward into the formation and causing the pressurized fluid to be directed against the formation, and whipstock means disposed downstream of said first seal, said drill string substantially changing direction on movement through said whipstock means.

* * * * *